United States Patent [19]

Maines et al.

[11] Patent Number: 4,842,656

[45] Date of Patent: Jun. 27, 1989

[54] ANISOTROPIC NEODYMIUM-IRON-BORON POWDER WITH HIGH COERCIVITY

[75] Inventors: James R. Maines, Westfield; David Arnold, Anderson, both of Ind.

[73] Assignee: General Motors Corporation, Detroit, Mich.

[21] Appl. No.: 62,533

[22] Filed: Jun. 12, 1987

[51] Int. Cl.[4] ..... H01F 1/06

[52] U.S. Cl. ..... 148/302; 75/251; 148/105; 148/120; 148/121; 148/304; 252/62.54

[58] Field of Search ..... 148/105, 120, 121, 302, 148/304; 75/251; 420/83, 121; 252/62.54

[56] References Cited

U.S. PATENT DOCUMENTS 4,710,239 1/1987 Lee et al. ..... 148/101

FOREIGN PATENT DOCUMENTS 133758 3/1985 European Pat. Off. .
141901 9/1982 Japan .

OTHER PUBLICATIONS

Lee, "Hot-Pressed Neodymium-Iron-Boron Magnets", Applied Physics Letter, vol. 46, No. 8, Apr. 1985, pp. 790-791.

*Primary Examiner*—Robert McDowell
*Attorney, Agent, or Firm*—George A. Grove

[57] ABSTRACT

Magnetically anisotropic powder having high coercivity and containing the magnetic phase $Nd_2Fe_{14}B$ is produced by melt spinning a composition of these elements to form amorphous or extremely finely crystalline particles which are hot worked to produce grains containing the above phase and having dimensions in the range of about 20 to 500 nanometers. When the hot worked body is comminuted to powder, the resultant particles are magnetically anisotropic and have appreciable coercivity at room temperature.

3 Claims, 1 Drawing Sheet

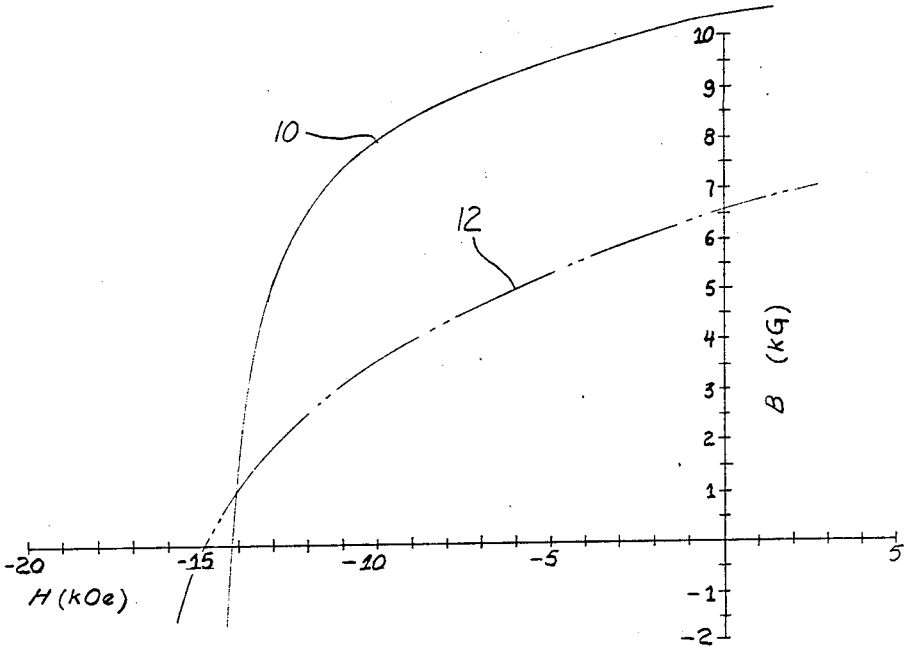
10
12
10
9
8
7
6
5
4
3
2
1
-1
-2
B (kG)
-20
-15
-10
-5
5
H (kOe)

ANISOTROPIC NEODYMIUM-IRON-BORON POWDER WITH HIGH COERCIVITY

This invention relates to a method of making a powdered composition based on iron, neodymium and/or praseodymium, and boron which has appreciable magnetic coercivity at room temperature and is magnetically anisotropic. This powder may be used to make anisotropic permanent magnet bodies in which the individual magnetic particles are aligned and bonded together with a suitable amount of organic resin, low melting metal alloy or the like.

BACKGROUND OF THE INVENTION

Permanent magnets based on compositions containing iron, neodymium and/or praseodymium, and boron are now known and in commercial usage. Such permanent magnets contain as an essential magnetic phase grains of tetragonal crystals in which the proportions of iron, neodymium and boron (for example) are exemplified by the empirical formula $Nd_2Fe_{14}B$. These magnet compositions and methods for making them are described in U.S. Pat. No. 4,802,931. The grains of the magnetic phase are surrounded by a second phase that is typically neodymium-rich as compared with the essential magnetic phase. It is known that magnets based on such compositions may be prepared by rapidly solidifying a melt of the composition to produce fine grained, magnetically isotropic platelets of ribbon-like fragments. Magnets may be formed from these isotropic particles by practices which are known and which will be discussed further herein.

Melt spinning is an efficient method of producing rapidly solidified particles of iron-neodymium-boron compositions. The melt-spun particles, either as is or after a suitable anneal, are magnetically isotropic and have high coercivity at room temperature. They may be used to make resin bonded magnets that are magnetically isotropic. The isotropic powder has many useful applications, but there is also a need for an anisotropic powder with a coercivity of at least 1,000 Oersted at room temperature.

It is also known that iron-neodymium-boron permanent magnets can be prepared starting with cast ingots or atomized powder of suitable compositions. The ingots or powder are comminuted to form micron-size (e.g., 1 to 15 microns) powder. These particles are magnetically anisotropic. They are aligned in a suitable magnetic field, compacted into magnet bodies and sintered to form permanent magnets.

When iron-neodymium-boron ingots are pulverized, the resulting powder is magnetically anisotropic, but it has little coercivity. Similarly, if a melt is atomized by conventional atomization techniques, such powder is magnetically anisotropic but has little coercivity. It is only after such powder has been compacted and sintered that the magnets display any appreciable coercivity. Workers have attempted to pulverize such anisotropic permanent magnets in order to obtain a coercive anisotropic permanently magnetic powder. Unfortunately, however, pulverization of the permanent magnet bodies yields a powder that has little coercivity.

It is known that the melt-spun isotropic powder can be suitably hot pressed and/or hot worked and plastically deformed to form high strength anisotropic permanent magnets. This practice is described in U.S. Pat. No. 4,792,367. Such magnets have excellent magnetic properties. However, there remains a need for a magnetically anisotropic high coercivity iron-neodymium-boron type composition powder that can be magnetically aligned and molded with a suitable bonding agent to form a bonded anisotropic permanent magnet.

Accordingly, it is an object of our invention to provide magnetically anisotropic, high coercivity (e.g., greater than 1,000 Oersted at room temperature) particulate compositions based on iron, neodymium and/or praseodymium, and boron. As will be described, suitable amounts of other elements such as cobalt, nickel, aluminum, copper and the like may be added as well as suitable amounts of other rare earth metals. However, the composition of our powder is based on the essential constituents of iron, neodymium and/or praseodymium, and boron.

It is also an object of our invention to provide a method of making such magnetically anisotropic and coercive powder.

SUMMARY OF THE INVENTION

In general, our compositions suitably comprise, on an atomic percentage basis, 40 to 90 percent of iron or mixtures of cobalt and iron, 10 to 40 percent of rare earth metal that necessarily includes neodymium and/or praseodymium and at least one-half percent boron. Preferably, iron makes up at least 40 atomic percent of the total composition and neodymium and/or praseodymium make up at least 6 atomic percent of the total composition. Preferably, the boron content is in the range of 0.5 to 10 atomic percent of the total composition, but the total boron content may suitably be higher than this. It is preferred that iron make up at least 60 percent of the non-rare earth metal content. It is also preferred that neodymium and/or praseodymium make up at least 60 percent of the rare earth content.

We have found that we can make our magnetically anisotropic powder by starting with such a composition that has been suitably rapidly solidified to produce an amorphous material or a finely crystalline material in which the grain size is less than about 400 nanometers in largest dimension. We prefer, however, that the rapidly solidified material be amorphous or, if extremely finely crystalline, have a grain size smaller than about 20 nanometers. Such material may be produced, for example, by melt spinning.

Such rapidly solidified material is hot pressed in a die at temperatures on the order of 700° C. or higher and at a pressure and for a time to form a fully dense material that has magnetic coercivity at room temperature in excess of 1,000 Oersted and preferably in excess of 5,000 Oersted. Usually, when melt-spun material, finer than 20 nanometers in grain size, is heated at about 750° C. for a period of a minute or so and hot pressed to full density, the resultant body is a permanent magnet. Further, the magnetic body is slightly magnetically anisotropic. If the particulate material has been held at the hot pressing temperature for a suitable period of time, it will then have a grain size in the range of about 20 to 500 nanometers, preferably about 20 to 100 nanometers. If the hot pressed body is then hot worked, that is, plastically deformed at such an elevated temperature, to deform the grains without affecting an increase in grain size above 500 nanometers, the resultant product displays appreciable magnetic anisotropy, and it may have an energy product of about 30 MegaGaussOersted or higher.

When we speak of our powder composition as being magnetically anisotropic, it is meant that each particle has a preferred direction of magnetization. Thus, a quantity of such particles can be magnetically aligned and bonded together to form a magnet body that has a preferred direction of magnetization.

We have discovered that when such hot pressed or hot worked bodies are then pulverized to a powder, the particles of the powder are both magnetically anisotropic and have retained appreciable magnetic coercivity. Thus, our powder may have particles preferably in the size range of about 50 to 150 microns. Each powder particle contains many of the deformed and aligned grains and each grain is platelet shaped with a largest dimension no greater than about 500 nanometers. The grains contain aligned $Fe_{14}Nd_2B$ (or the equivalent) tetragonal crystals that provide magnetic properties to the material.

We were surprised that our powder had appreciable coercivity at room temperature because, as stated above, powder produced by pulverizing sintered permanent magnets has little coercivity.

Further objects and advantages of our invention will be more apparent from the detailed description which follows.

BRIEF DESCRIPTION OF THE DRAWING

In the drawing, the FIGURE is a demagnetization curve illustrating the permanent magnet properties of prior art magnetically isotropic powder and the magnetically anisotropic powder produced by our invention.

DETAILED DESCRIPTION OF THE INVENTION

An alloy ingot comprising by weight 28 percent neodymium, 1.2 percent boron, and the balance iron except for small amounts of incidental impurities was obtained. This composition contained, on an atomic percent basis, 12.3 percent neodymium, 7.1 percent boron, and 80.6 percent iron. The composition was melted by induction heating under a dry, substantially oxygen-free argon atmosphere to form a uniform molten composition. While under such atmosphere and at a pressure of 2–3 psig, it was transferred into an alumina tundish and ejected down through a ceramic nozzle with a 0.6 mm orifice onto the perimeter of an 18 inch diameter copper wheel rotating with a surface velocity of about 30 meters per second. When the melt struck the copper wheel, which was at a nominal temperature of 100° F., it solidified substantially instantaneously to form ribbon fragments which were thrown from the wheel. The fragments were collected. They were substantially amorphous.

This amorphous, melt-spun iron-neodymium-boron composition was then milled to a powder which would pass through a 40 mesh screen. The powder was then heated to a temperature of about 750° C. in a die and compacted between upper and lower punches to form a flat cylindrical plug one inch in diameter by $\frac{5}{8}$ inch in thickness. The still hot fully densified body was then transferred to a larger die at 750° C. in which it was die upset to form cylindrical plug $1\frac{3}{8}$ inch in diameter by $\frac{1}{4}$ inch in thickness.

This die upset body was an unmagnetized composition that had appreciable magnetic coercivity and was magnetically anisotropic. The grains in the body were flattened and aligned with their major dimension lying transverse to the direction of pressing. The maximum dimensions of the grains were in the range of about 100 to 300 nanometers. The grains contained tetragonal crystals in which the proportions of iron, neodymium and boron were in accordance with the formula $Nd_2Fe_{14}B$. When hot pressed blocks thus prepared are magnetized in a field of 25 kiloOersteds, a permanent magnet is produced typically having a maximum energy product at room temperature of about 32 MegaGaussOersteds, a residual induction of 11.75 kiloGauss, and an intrinsic coercive force ($H_{ci}$) of 13.0 kiloOersteds. The density of the die upset body is about 7.5 g/cm$^3$.

The unmagnetized block was then pulverized at ambient temperature under argon at $1\frac{1}{2}$ inch water gauge positive pressure in a disk pulverizer to form a fine powder 50 to 100 micrometers in particle size. Each of the powder particles consisted of many plastically deformed and aligned grains of the $Nd_2Fe_{14}B$ phase. The grains in the powder were still in the 100 to 300 nanometer size range. The particles were magnetically anisotropic, as will be demonstrated.

A small portion of the powder was then mixed with a two-part liquid epoxy of the type curable in 12 to 24 hours at room temperature. Eighty parts by weight of anisotropic powder were mixed with 20 parts by weight of epoxy, and the mixture was placed into a cylindrical cup-shaped metal container $\frac{1}{2}$ inch in diameter by one inch long. The container was nearly filled with the powder-epoxy mixture and a metal lid was placed on top of the mixture to substantially close the top of the container.

The container and its contents were then placed in a 20 kiloOersted magnetic field parallel to the axis of the container for 30 seconds to magnetically align the iron-neodymium-boron particles in the container. The container was then placed in a 10 kiloOersted field parallel to the axis of the container for 12 hours while the epoxy cured. Following this 12-hour period, the cured epoxy magnetic particle mixture was removed from the container and a small cube $\frac{1}{4}$ inch on each edge was cut from the cylindrical specimen. The cube was cut so that two opposing faces were perpendicular to the direction of the magnetic field applied to align the particles therein. In other words, the axis of the cube perpendicular to such opposing faces was parallel to the applied magnetic field. Thus, the other two orthogonal axes of the cube were transverse to the direction of magnetic alignment of the particles in the cubic specimen.

The cube was then placed into a vibrating sample magnetometer (VSM). The cube was oriented in the VSM such that its axis parallel to the direction of alignment was parallel to the direction of the field applied by the magnetometer. The sample was then magnetized to saturation and then demagnetized in the VSM. Curve 10 in the FIGURE of the drawing is the second quadrant demagnetization curve of the cubic sample aligned parallel to the magnetometer field. The ordinate of the graph is magnetic induction, B, in kiloGauss and the absciss is coercivity, H, in kiloOersteds.

The sample was then reoriented in the magnetometer such that its axis of particle magnetic alignment was transverse to the magnetometer field. The sample was again magnetized to saturation and demagnetized. Curve 12 of the FIGURE of the drawing is the demagnetization curve for the sample in a direction transverse to the direction of alignment of the particles in the cube. This experiment was repeated with the cubic sample oriented in the magnetometer with its third axis (perpendicular to opposite faces) aligned with the field of the magnetometer. Of course, in this position, the cube was still aligned with its preferred direction of magnetization transverse to the field of the magnetometer. The sample was again magnetized to saturation and demagnetized in the magnetometer. The demagnetization curve for the sample in this orientation was substantially identical to curve 12 of the drawing.

Inspection of the FIGURE of the drawing shows that the powder produced by pulverization of hot pressed, magnetically anisotropic blocks indeed was magnetically anisotropic and had appreciable coercivity (e.g., 14–15 kiloOersted as seen in the drawing graph). The epoxy resin in the sample served to hold the iron-neodymium-boron particles in their magnetically aligned position even when the sample was magnetized in fields oriented transverse to the alignment direction. The sample when aligned parallel to the magnetometer field had a residual induction much higher than when the sample was aligned transverse to the field of the magnetometer. The coercivity of the sample at zero induction when aligned parallel to the magnetometer field was lower than its coercivity when the sample was aligned transverse to the magnetometer field. Such results are characteristic of a magnetically anisotropic material.

Resin bonded magnets containing our anisotropic iron-neodymium-boron powder and, e.g., a two-part liquid epoxy can be made by a practice like that described above. For example, the anisotropic powder can be sifted to select the −270 mesh +325 mesh portion and mixed with a suitable portion of epoxy. The mixture is magnetically aligned in a magnetic field and then compacted in a press into the desired shape. The compact can be heated in a hot air stream for a period of 15 minutes or so to cure the epoxy resin. The epoxy bonded body is then magnetized to saturation in a suitable field. The resulting magnet body is characteristic of a magnetically anisotroic material.

In summary, we have produced magnetically anisotropic powder with high coercivity by initially providing melt spun (i.e., very rapidly solidified) metal particles that are amorphous or of extremely fine grain size. The particles are then either hot pressed and/or hot worked to produce plastically deformed and aligned grains in the consolidated mass that are in the size range of about 20 to 500 nanometers. The consolidation and hot deformation of the particles can be carried out by any of several suitable processes such as hot pressing, hot isostatic pressing, hot die upsetting, forging, extrusion, rolling and the like. Since the grains are deformed so that they are aligned with their major dimensions in the direction of the flow of the deformed material (usually perpendicular to the force applied for hot working), the body is magnetically anisotropic and coercive. When the body is pulverized, the resultant powder retains its magnetic coercivity and is also magnetically anisotropic. Our practice is applicable to suitable compositions that necessarily contain iron, neodymium and/or praseodymium, and boron in the amounts specified above. The composition may also contain other constituents providing that the anisotropic particles necessarily contain the magnetic phase $RE_2TM_{14}B$ along with at least one additional phase at the grain boundaries that are richer in rare earth. In the essential magnetic phase, TM is preferably at least 60 percent iron and RE is preferably at least 60 percent neodymium and/or praseodymium.

While our invention has been described in terms of a preferred embodiment thereof, it will be appreciated that other forms could readily be adapted by those skilled in the art. Accordingly, our invention is to be considered limited only by the following claims.

The embodiments of the invention in which an exclusive property or privilege is claimed are defined as follows:

1. A method of making magnetically anisotropic particles of a composition that has as its magnetic constituent the tetragonal crystal phase $RE_2TM_{14}B$ wherein the particles have an intrinsic coercivity at room temperature of at least 1,000 Oersteds, said method comprising:

providing a hot worked body comprising plastically deformed, platelet-shaped grains of said phase wherein said grains are aligned and have an average largest dimension no greater than about 500 nanometers, the composition of said body comprising, on an atomic percent basis, about 40 to 90 percent transition metal (TM) taken from the group consisting of iron and mixtures of iron and cobalt wherein iron makes up at least 40 percent of the total composition, about 10 to 40 percent rare earth metal (RE) wherein at least about 6 percent of the total composition is neodymium and/or praseodymium, and at least 0.5 percent boron, and comminuting said body to form a powder, the individual particles of said powder each comprise many of said aligned grains, said particles thus being magnetically anisotropic and having said magnetic coercivity.

2. A method of making magnetically anisotropic particles of a composition that has as its magnetic constituent the tetragonal crystal phase $RE_2TM_{14}B$ wherein the particles have an intrinsic coercivity at room temperature of at least 1,000 Oersteds, said method comprising:

rapidly solidifying a melt of a composition comprising, on an atomic percent basis, about 40 to 90 percent transition metal (TM) taken from the group consisting of iron and mixtures of iron and cobalt wherein iron makes up at least 40 percent of the total composition, about 10 to 40 percent rare earth metal (RE) wherein at least about 6 percent of the total composition is neodymium and/or praseodymium, and at least 0.5 percent boron, and forming a particulate solid material thereof in which crystalline material, if present, has a grain size no larger than about 400 nanometers, hot pressing said particles into a body and thereafter hot working said body to plastically deform the original particulate constituents so as to thereby produce in the body aligned platelet-shaped grains of said magnetic phase wherein the largest average dimension is no greater than about 500 nanometers, and comminuting said body to form a powder, the individual particles said powder each comprise many of said grains, said particles thus being magnetically anisotropic and having said magnetic coercivity.

3. Magnetically anisotropic particles of a composition that has as its magnetic constituent the tetragonal crystal phase $RE_2TM_{14}B$, the particles each comprising many aligned, platelet-shaped grains of said phase no larger than about 500 nanometers in greatest dimension and having an intrinsic coercivity at room temperature of at least 1,000 Oersteds, the composition of said particles comprising, on an atomic percent basis, about 40 to 90 percent transition metal (TM) taken from the group consisting of iron and mixtures of iron and cobalt such that iron makes up at least 40 percent of the total composition, about 10 to 40 percent rare earth metal (RE) such that at least about 6 percent of the total composition is neodymium and/or praseodymium, and at least 0.5 percent boron.

* * * * *